US006247410B1

(12) United States Patent
Garcia

(10) Patent No.: US 6,247,410 B1
(45) Date of Patent: Jun. 19, 2001

(54) HIGH-OUTPUT INSENSITIVE MUNITION DETONATING CORD

(75) Inventor: Felipe Garcia, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/215,923

(22) Filed: Dec. 10, 1998

(51) Int. Cl.[7] ..... C06C 5/04; C06C 7/00; C06C 5/00

(52) U.S. Cl. ..... 102/275.8; 102/275.1; 102/275.9

(58) Field of Search ..... 102/275.8, 275.1, 102/275.9

(56) References Cited

U.S. PATENT DOCUMENTS

| | | | | |
|---|---|---|---|---|
| 920,118 | * | 5/1909 | Ellsworth | 102/275.1 |
| 3,155,038 | * | 11/1964 | Smith | 102/27 |
| 3,382,802 | * | 5/1968 | Prior et al. | 102/27 |
| 3,908,549 | * | 9/1975 | Turner | 102/27 |
| 4,083,305 | * | 4/1978 | Garrison et al. | 102/27 |
| 4,178,853 | * | 12/1979 | Garrison et al. | 102/27 |
| 4,230,041 | * | 10/1980 | Bailey et al. | 102/27 |
| 4,312,272 | * | 1/1982 | Baker et al. | 102/275.8 |
| 5,945,627 | * | 8/1999 | Arpin et al. | 102/202.11 |

* cited by examiner

*Primary Examiner*—Michael J. Carone
*Assistant Examiner*—Aileen J. Baker
(74) *Attorney, Agent, or Firm*—Harvey A. Gilbert; Donald G. Peck

(57) ABSTRACT

A detonating cord has a core of highly brisant PBXN-8 explosive surrounded by an inner braided layer of polyamide yarn, a flexible sealing sleeve of silicone rubber coated with glue, and an outer braided layer of polyamide yarn adhered to the sealing sleeve. Booster cups may be crimped to opposite ends of detonating cord to place booster charges adjacent the core to assure more reliable detonation of associated ordnance. The method of manufacture of detonating cord calls for providing a core of explosive PBXN-8 slurry, weaving an inner braided layer of polyamide yarn on the core, squeezing moisture out of the core of explosive PBXN-8 slurry during the weaving of the inner braided layer, applying a flexible sleeve of silicone rubber on the inner braided layer, coating glue on the flexible sleeve, and weaving an outer braided layer of polyamide yarn on the glue. Optionally, squeezing the core of explosive PBXN-8 slurry between rollers may be desirable to further remove excess moisture. The detonating cord of this invention provides safe, reliable, and non-electric detonation of boostered or boosterless insensitive warheads or shaped charges distributed along a line. The detonating cord of this invention: (a) withstands severe dynamic loading, (b) survives extreme environmental and logistics conditions, survives landing over razor sharp wire obstacles like triple standard concertina, and (c) meets all US DOD IM requirements of MIL-STD-2105 and NAVSYSCOMINST 8010.5.

9 Claims, 1 Drawing Sheet

HIGH-OUTPUT INSENSITIVE MUNITION DETONATING CORD

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATIONS

This is a continuation in part of copending U.S. patent applications entitled "Reliable and Effective Line Charge System" by Felipe Garcia et al., U.S. Patent and Trademark Office Ser. No. 09/012,932, filed Jan. 24, 1998, "Line Charge Insensitive Munition Warhead" by Felipe Garcia et al., U.S. Patent and Trademark Office Ser. No. 08/944,049, filed Sep. 12, 1997, "Line Charge Connector" by Felipe Garcia et al., U.S. Patent and Trademark Office Ser. No. 09/030,578, filed Feb. 23, 1998, "Magneto-Inductive On-Command Fuze" by Robert Woodall et al., U.S. Patent and Trademark Office Ser. No. 09/228,074 (NC 78,802), filed Jan 5, 1999, and "Line Charge Fabrication Facility and Procedures" by Robert Woodall et al., U.S. Patent and Trademark Office Ser. No. 09/257,142 (NC 78,938), filed Feb. 23, 1999, and incorporates all references and information thereof by reference herein.

BACKGROUND OF THE INVENTION

This invention relates to detonating cords. In particular, this invention relates to rugged and safe detonating cords used for reliable detonation of explosive line charges.

Explosive line charges have been used to breach an obstructed area. Usually an interconnected line of distributed explosive charges is pulled across the area by a rocket motor and detonated to clear the obstacles and mines in a narrow lane. Sometimes, detonation and clearing do not always go as planned due to failure in the detonation trains. They fail because line charges are expected to perform under extremely adverse conditions to accomplish difficult missions during combat, and often are subjected to numerous abuses as they are transported to and emplaced in the field. In addition, they must survive intense self-destructive forces as they are deployed by rockets or other highly accelerating launch systems. After launch, impact with the ground, rocks, concertina wire, etc. also may interrupt or otherwise damage the detonation trains. Consequently, detonations are ineffective or interrupted along some of the line charges, and they do not clear paths through obstacles and mines.

Accordingly, an effective man-portable weapon system has been needed that could clear anti-personnel mines and wire obstacles. Contemporary man-portable systems cannot reliably withstand the severe dynamic loading, survive the extreme environmental and logistics conditions, and survive landing over razor sharp wire obstacles like triple standard concertina. None meet all U.S. DOD Insensitive Munition (IM) requirements of MIL-STD-2105 and Naval Systems Command Instruction (NAVSYSCOMINST) 8010.5. The energetic subsystems which include the detonating cords in all previous major weapon systems failed to meet IM requirements, specifically those requirements regarding bullet and fragment impact tests, and slow cook-off tests. In addition, these weapon systems failed to meet the minimum operational requirements associated with mine and wire obstacle breaching during assault. This was because their explosive subsystems (including the detonating cords) led to either: (a) unreliable detonation after exposure to environmental operational conditions, (b) unexpected detonations when exposed to the impact of arms fire as expected during assault breaching operations, or failure to survive landing over razor sharp wire obstacles like triple standard concertina.

In other words, the detonating cords used in some contemporary line charges do not reliably survive deployment via a rocket motor since extreme loads were imposed upon the detonating cord as the line charge flies out of its container at launch and as it impacts the ground during landing. This denied personnel the welcomed operational benefit of being able to emplace and detonate line charges from standoff positions. Use of other industry standard and best commercially available detonating cords fared no better and resulted in repeated failures of the detonating cords. This is because the fast traveling detonating cords could not survive the whip-like acceleration & deceleration environment, as well as the tremendous shearing forces associated with the impact upon razor sharp wire obstacles. Commercial detonating cords have been modified to help survive launch and landing, but physical contraction and expansion cycles over normal temperature and humidity extremes created gaps in the explosive cores at the ends of the detonating cords. This compromises reliability.

Thus, in accordance with this inventive concept, a need has been recognized in the state of the art for detonating cord that survives the rigors of environment and logistics, severe dynamic loads during deployment, and impact during landing to reliably transfer detonation.

SUMMARY OF THE INVENTION

The present invention is directed to providing detonating cord having a core of highly brisant PBXN-8 explosive surrounded by an inner braided layer of polyamide yarn, a flexible sealing sleeve of silicone rubber coated with glue, and an outer braided layer of polyamide yarn adhered to the sealing sleeve.

Another object of the invention is to provide detonating cord that reliably transfers detonation.

Another object of the invention is to provide detonating cord having an insensitive plastic-bonded granular explosive.

An object of the invention is to provide safe, reliable non-electric detonating cord to transfer detonation to boostered or boosterless warheads having insensitive explosives.

Another object of the invention is to provide detonating cord that survives the rigors of extreme environmental and logistics conditions, severe dynamic loads during deployment, and impact during landing on sharp obstacles to reliably detonate explosives.

Another object of the invention is to provide detonating cord that does not react, but in the worst case may burn, when exposed to fast cook-off, slow cook-off, drops from up to 40 ft., bullet impact, and fragment impact.

Another object of the invention is to provide detonating cord that reduces cutting & abrasion during storage and transportation cycles and during deployment and subsequent impact with razor sharp wire obstacles.

Another object of the invention is to provide detonating cord that reduces explosive core gaps within the explosive core and at its ends which are induced by thermal linear contraction and expansion cycles experienced during normal temperature and humidity extremes.

Another object of the invention is to provide detonating cord that increases reliability of detonation between detonating cord segments and between fuzes and detonating cord segments by reducing dimensional changes caused by aging and thermosetting of polymeric thermoplastic.

Another object of the invention is to provide detonating cord that reduces explosive core contamination from inexorable thermal linear contraction and expansion cycles experienced during normal temperature, humidity, shock, and vibrational cycling extremes to reliably detonate detonating cord assemblies and fuzes with detonating cord assemblies.

Another object of the invention is to provide detonating cord that reduces gaps within the explosive core and at its ends that are induced during deployment and subsequent impact and stem from tensile strength and elongation effects to reliably transfer detonation.

Another object of the invention is to provide detonating cord that provides a high temperature resistant composite polyamide and silicon rubber shield capable of containing the effects of a burning explosive core, while providing structural resiliency to preclude escalatory transitions from burning to deflagration or detonation.

Another object of the invention is to provide detonating cord having structure for high strength to confine precursory detonation shock waves to ensure reliable axial propagation of detonation and to preclude effecting propagation of unwanted mass detonation. Another object of the invention is to provide detonating cord that prevents gaps between the core and boosters when exposed to normal temperature and humidity extremes of logistical cycling to reliably detonate detonating cord assemblies, fuzes, and detonating cords.

Another object of the invention is to provide detonating cord having a plastic-bonded granular explosive compacted into braided composite structures to create explosive-core density levels sufficient to support brisant detonation velocities of minimum average of 7,000 meters per second, while retaining a granular & flexible explosive core of desensitized (plastic-bonded) RDX grains.

Another object of the invention is to provide detonating cord including having plastic-bonded granular explosives having less than 50% impact sensitivity of a class 5 RDX explosive at the high brisance velocity of detonation of about 7,000 meters per second that produces average dents of 0.030 inches in a steel dent block of 80 to 93 Rockwell B Hardness, within a temperature range of −30 to +130° F.

Another object of the invention is to provide detonating cord having a core of granular, plastic-bonded explosive in a detonating cord capable of detonating the highly insensitive munition explosive PBXN-9 by radially outwardly traveling shock waves.

Another object of the invention is to provide detonating cord having extensive applications in seismic, oil exploration, and underwater imaging fields.

Another object of the invention is to provide detonating cord that is fast, inexpensive, and highly insensitive to provide for safe and reliable non-electric detonation of boostered or boosterless insensitive warheads or shaped charges distributed along a line charge, a two-dimensional array of detonating cords, or a three-dimensional array of detonating cords.

These and other objects of the invention will become more readily apparent from the ensuing specification when taken in conjunction with the appended claims.

DESCRIPTION OF THE PREFERRED EMBODIMENT

In view of the limitations of the prior art, the MK7 Anti-Personnel Obstacle Breaching System (APOBS) evolved and is in production for the U.S. Marine Corps. The line charge of APOBS is made in accordance with the copending patent application referenced above, "Reliable and Effective Line Charge System." Essential to the safety, reliability, and effectiveness of this system is detonating cord 10 of this invention.

Figure 1:
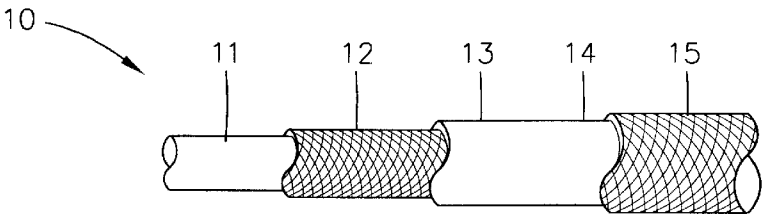
FIG. 1 is a cross-sectional view of a length of detonating cord according to this invention.
Figure 2:
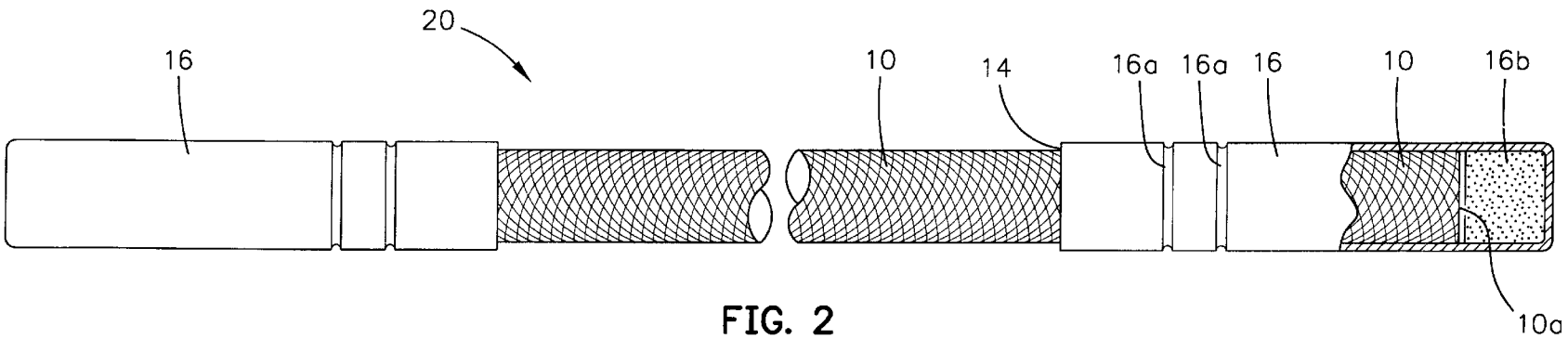
FIG. 2 is a cross-sectional view of a detonating cord assembly having booster charges in cups crimped onto opposite ends of detonating cord according to this invention.

Referring to FIGS. 1 and 2, detonating cord 10 has core 11 made up from highly brisant PBXN-8 explosive surrounded by inner braided layer 12 of polyamide yarn, flexible sleeve 13 of silicone rubber coated with glue 14, and outer braided layer 15 of polyamide yarn.

Detonating cord 10 may extend many feet in length and be fashioned into detonating cord assemblies 20 to detonate many explosive charges virtually simultaneously. Opposite ends 10*a* of detonating cord 10 may have booster cups 16 crimped onto opposite ends via pairs of parallel annular crimps 16*a*. Each booster cup 16 may be made of soft aluminum alloy for holding booster charge 16*b*. Each booster charge 16*b* is sealed in each cup 16 by adhesive glue 14 that is compressed into intimate structural contact via crimps 16*a*. Cups 16 each have wall thicknesses of about 0.0145 to 0.020 inches and contain booster charge 16*b* at their distal ends to transfer detonation to other ordnance or another detonating cord assembly 20 coupled in-line. The separation or gap between each end 10*a* of detonating cord 10 and each booster charge 16*b* is about 0.020 inches or less to assure transfer of detonation.

When core 11 of detonation cord 10 is made of PBXN-8 and is crimped onto booster cup 16 that has booster charge 16*b* of about 5.4 grains of military explosive composition A-5, Class 2, (MIL-E-14970), detonation produces an average dent of 0.030 inches into a 1.25"×1.25"×0.625" thick steel dent block of 80 to 90 Rockwell B Hardness. An explosive shock wave of this magnitude axially travels in-line from detonating cord 10 to detonate radially outwardly connected ordnance.

Core 11 is made from explosive PBXN-8. Core 11 is shaped as a continuously extending, cylindrical, or thick wire-shaped volume of PBXN-8 explosive. PBXN-8 is a plastic-bonded, granular explosive material containing RDX, stearic acid, and hydroxyethyl cellulose. Therefore, the acronym PBXN-8 is derived from the words: plastic-bonded explosive and navy since it was designed for the U.S. Navy, and it was designated explosive number 8. Although the use of PBXN-8 is disclosed herein, it is understood that other explosive compositions could be used if they have similar properties of brisance, impact sensitivity, detonation, etc. Core 11 of PBXN-8 explosive may be recovered from either the premix of PBXN-8 to be described below, or from a manufacturer of explosives that fabricates in accordance with applicable drawings and specifications.

PBXN-8 is composed of substantially the following proportions:

| Ingredient | Composition (weight %) | Specification |
|---|---|---|
| RDX[1] | 98.0 ± 2.0 | MIL-R-398 |
| Stearic Acid | 1.0 ± 0.5 | MIL-S-271 (Except for Titer test) |
| Hydroxyethyl cellulose | 1.0 ± 0.5 | WS 32588 |

where, RDX[1] consists of 2 RDX Classes: RDX Class 5 and RDX Class 7. The weight ratio of RDX Class 5 to RDX Class 7 is 50/50. To allow for lot-to-lot variations in the RDX classes, this weight percent ratio is allowed to vary from a minimum 45/55 ratio to a maximum 55/45 ratio.

RDX is a well-known explosive that is available from a number of commercial sources. When a Class 5 RDX sample was tested at the same time as PBXN-8, PBXN-8 was found to have an impact sensitivity of less than 50% of the impact detonation point of the Class 5 RDX standard.

A typical batch of the material starting composition (premix) of PBXN-8 slurry included ingredients in the following proportions:

| Ingredient | Quantity | Specification (U.S. Gov. Docs.) |
|---|---|---|
| RDX, Type 2, Class 7 | 25 lb. | MIL-R-398 |
| RDX, Type 2. Class 5 | 25 lb. | MIL-R-398 |
| Stearic Acid | 229 grams | MIL-S-271 |
| Hydroxyethyl cellulose | 217 grams | WS 32588 |
| Ionized Water | 28.37 lb. | MS 1218 |
| Tributyl Phosphate | 15 cubic centimeters (cc) | technical grade |
| Ammoniuym Hydroxide | 5 cc | O-A-451 |

To manufacture the PBXN-8 all ingredients should be slurried in the water at room temperature until the viscosity (from the hydroxyethyl cellulose) reaches a maximum. The PBXN-8 slurry is extruded from a hopper into an empty cord which at this point consists of at least one loosely woven sub-layer of inner braided layer 12 of polyamide yarn. This structure may be run through rollers to press out most of the water. The extrusion rate of explosive PBXN-8 from the hopper should be such that a completed detonation cord 10 contains the specified grains per foot of PBXN-8 material when the cord is completely dry. This amount may be between a minimum 115 and maximum 145 grains per foot.

As mentioned above, first sub-layer of inner braided layer 12 is loosely woven on PBXN-8 as it is extruded from a hopper. The hopper is adjusted to provide an amount of extruded material that is approximately equal to a desired weight per linear foot of PBXN-8 for core 11 of detonating cord 10. Polyamide yarns of Types II and III are woven together in this first sub-layer of braided layer 12 in any of a variety of well-known patterns of spaced-apart fibers, or filaments of the yarns that extend along the length of detonating cord 10 that is being formed. Type II is a filament yarn of denier 1500 marketed under the trademark KEVLAR 29, Type 964, and Type III is a filament yarn of denier 1200 marketed under the trademark NOMEX, Arimid, Type 430. Both KEVLAR 29 and NOMEX are trademarks of E. I. duPont de Nemours & Co., Fibers Department, Industrial Products Division, Wilmington, DE 19808.

Sub-layers of inner braided layer 12 are woven from Types II and III polyamide yarn, and these sub-layers are drawn tighter during the weaving process. This tightening not only reduces the size of core 11 but also squeezes some excess water out of the PBXN-8 slurry. Core 11 may be passed through rollers before or after this phase of the manufacturing process to squeeze more excess moisture out if needed.

Core 11 thus is formed to have the right diameter, and hence, the correct weight per linear foot of PBXN-8 for detonating cord 10. Core 11 then may be placed in a heated room for a minimum of 24 hours until the moisture content is less than or equal to 0.5 percent.

Optionally, core 11 may have been preformed and cured, or dried to the right moisture content and weight per linear foot earlier. In this case, weaving of additional sub-layers in appropriate patterns of fibers for inner braided layer 12, can proceed on core 11 uninterrupted without squeezing by weaved yarn, squeezing between rollers, or drying.

Now, flexible sealing sleeve 13 is added to cover inner braided layer 12. Flexible sleeve 13 may be a silicone compound extruded, or otherwise applied onto inner braided layer 12 after it has been woven on core 11. A typical, suitable silicone compound which satisfactorily adheres to the exterior of inner braided layer 12 and has sufficient strength, resilience, ruggedness, and environmental sealing properties is the product marketed by Dow Corning Corp., 5775 Peachtree-Dunwoody Rd., Atlanta, Ga. 30342-1505, and identified as product No. 1349-T(RED).

After flexible sleeve 13 has been applied, glue 14 is coated on its exterior. Glue 14 adheres to the exterior of flexible sleeve 13 and has appropriate adhesive qualities to bond to the filaments of outer braided layer 15 when it is woven on sleeve 13. One typical glue product that has worked satisfactorily is marketed under the trademark, ELMER'S PROFESSIONAL CARPENTER'S WOOD GLUE, by Borden Consumer Products Div., 180 E. Broad St., Columbus, Ohio 43215.

Outer braided layer 15 is woven onto flexible sleeve 13 and glue coating 14, preferably while glue 14 is still tacky. Polyamide yarn of Type I is woven together in any of a variety of well-known patterns that extend along the length of detonating cord 10 that is being formed. Type I is a filament yarn of denier 1000 marketed under the trademark KEVLAR 29, Type 964, by E. I. duPont de Nemours and Co., Fibers Dept., Industrial Products Division, Wilmington, Del. 19808. More glue 14 may be added during weaving of outer braided layer 15 to hold successively woven sub-layers of outer braided layer 15 if desired.

The procedures for weaving inner braided layer 12 of polyamide yarn on core 11, applying flexible sleeve 13 of silicone rubber on inner braided layer 12, coating glue 14 on flexible sleeve 13, and weaving outer braided layer 15 of polyamide yarn on glue coating 14 are in accordance with known capabilities of commercial manufacturing equipment for detonating cord and well-known textile manufacturing practices. Typically, given the specs, of detonating cord 10, explosives manufacturer, Ensign-Bickford Co., Hwy 175, P.O. Box 128, Graham, Ky. 42344-9701, would make it. Other explosives manufactures, such as Hercules Powder Co., Austin Powder Co., etc., also would produce detonating cord 10 according to specifications.

The detonation velocity of detonating cord 10 has a minimum average of 7,000 meters per second with no detonating velocity in cord 10 falling below 6,800 meters per second. The tensile strength of detonating cord 10 has a minimum average value of about 400 pounds, and no tensile strength in any part of the cord falls below 350 pounds. For use in APOBS as mentioned above, core 11 contains about 120 grains of PBXN-8 explosive per foot. However, the explosive loading density can be varied depending upon the type of warhead that the detonating cord is intended to initiate by increasing the radial dimensions or by increasing the actual explosive loading density within a given radial geometry. During development of APOBS, the explosive loading density was increased from a minimum of 115 to a maximum of 145 grains per foot (26% explosive loading increase) to ensure direct detonation of the main charges of explosives of the APOBS warheads (PBXN-9) without the need of explosive boosters. This increase in loading density was made in detonating cord 10, while still meeting the same outer diameter requirement of no more than 0.295 inches.

After the manufacture of detonating cord 10, it is coiled and stored on spools having at least six foot diameters. Then sections of cord 10 can be payed out and cut to length as needed. Detonating cord assemblies 20 are made by crimping booster cups 16 with parallel annular crimps 16*a* onto opposite ends of the cut lengths of detonating cord 10.

The advantages of detonating cord 10 for detonating boostered or boosterless insensitive warheads distributed along detonating cord 10 are many. First of all, detonation cord 10 provides a highly insensitive non-electric way of to transfer detonation, and detonation cord 10 fully meets all the U.S. DOD IM requirements of MIL-STD-210S and the NAVSYSCOMINST 8010.5. As a result, detonation cord 10 does not react or burn when exposed to conditions like fast cook-off, slow cook-off, impact after falling 40 feet, bullet impact, fragment impact, etc.

Detonating cord 10 provides composite structure comprising polyamide fibers, silicon rubber, and a modified water-based aliphatic polymer to reduce: 1.) cutting and abrasions of detonating cord 10 during storage and transportation and during deployment and subsequent impact on razor sharp wire obstacles, 2.) degradations of transfer of detonation between interconnected segments of detonating cord 10 and between fuzes and segments of detonating cord 10 that otherwise result from linear dimensional changes caused by incompatible aging and thermosetting of polymeric thermoplastic, 3.) gaps within explosive core 11 and at ends 10*a* of detonating cord 10 that may otherwise be induced by inexorable thermal linear contraction and expansion cycles created by normal temp, and humidity extremes, 4.) gaps within core 11 induced during deployment and subsequent impact with razor sharp wire obstacles and stemming from tensile strength and elongation effects, and 5.) contaminations from outside of explosive of core 11 that were otherwise caused by inexorable thermal linear contraction and expansion cycles created by normal extremes of temp., humidity, shock, and vibration.

Detonating cord 10 fabricated in accordance with this invention further provides: A.) a high temperature resistant composite polyamide shield made up from braided layer 14 and silicon rubber sleeve 13 that is capable of containing the effects of burning explosive in core 11, while having sufficient structural resiliency to preclude an escalatory transition from burning to deflagration or a phase of reaction to detonation, B.) a high strength structure suitable to confine the precursory shock wave of detonation to ensure reliable detonation propagation throughout detonating cord 10 even though core 11 is extremely insensitive to initial initiation and propagation of detonation, and C.) a high strength composite structure suitable to preclude a precursory shock wave of detonation from effecting mass detonation propagation throughout detonating cord 10 unless core 11 is exposed to an axially directed precursory shock wave of detonation. For example in regard to C supra, if a commercial blasting cap is placed axially and in contact with the end of core 11 of detonating cord 10, detonation of the commercial blasting cap will result in reliable detonation of detonating cord 10. However, if a block of military explosive C-4 is placed in contact with but perpendicular to detonating cord 10, detonation of the C-4 will not reliably detonate cord 10.

Detonating cord 10 fabricated in accordance with this invention further provides soft aluminum alloy booster cups 16 to each hold explosive booster 16*b* sealed within by adhesive glue 14. Outer braided layer 15 and booster cups 16 are compressed into intimate structural contact with each other using two parallel annular crimps 16*a*. Crimping of cups 16 via crimps 16*a* and sealing with glue 14 prevent contamination of core 11 of detonating cord 10 when exposed to normal temperature & humidity extremes to ensure reliability of transfer of detonation between two detonating cord assemblies 20 or between fuzes and detonating cord assemblies 20. Crimping of cups 16 via crimps 16*a* and sealing with glue 14 also prevent gaps from developing between core 11 of detonating cord 10 and booster charges 16*b* of booster cups 16 when exposed to normal temperature & humidity extremes to ensure reliability of transfer of detonation between two detonating cord assemblies 20 or between fuzes and detonating cord assemblies 20.

Detonating cord 10 utilizes core 11 having novel plastic-bonded, granular detonating cord explosive PBXN-8 that contains RDX, Stearic Acid, Hydroxyethyl Cellulose, Ionized water, Tributyl Phosphate, and Ammonium Hydroxide. This material for core 11 is manufactured using a wet-slurry mixing and extrusion process and provides the following notable structural and explosive performance benefits: 1.) a plastic-bonded granular explosive that can be compacted inside of the braided composite structure of inner braided layer 12 to a density level in explosive core 11 sufficient to support detonation velocities having a minimum average of 7,000 meters per second, while retaining a granular & flexible explosive core of desensitized (plastic-bonded) RDX grains, 2.) a plastic-bonded granular explosive of less than 50% impact sensitivity of Class 5 RDX explosive, 3.) a highly brisant detonating cord 10 (detonation velocity of 7,000 meters per second) that produces an average dent of 0.030 inches into a steel dent block of 80 to 93 Rockwell B Hardness, at the temperature extremes of −30 to +130° F., 4.) a plastic-bonded granular explosive of remarkable insensitivity for core 11 that meets all US DOD IM requirements of MIL-STD-2105 and NAVSYSCOMINST 8010.5, and 5.) a granular, plastic-bonded explosive in core 11 having remarkable explosive output capable of detonating (without a booster) the highly insensitive munition, PBXN-9 (MIL-E-82875) pressed to highly insensitive densities of 1.68 to 1.73 gr/cc in grenades at temperature extremes between −30 to +130° F. and with explosive output from detonating cord 10 radially traversing outwardly through anodized 6061-T6 aluminum tubes in grenades.

Having the teachings of this invention in mind, alternate embodiments of this invention are numerous, with extensive applications in the seismic, oil exploration, and underwater imaging fields. This invention provides a fast, highly accurate, inexpensive, and highly insensitive means to provide safe, reliable, and non-electric detonation of boostered or boosterless insensitive warheads or shaped charges distributed along a line charge, a two-dimensional array of detonating cords, or a three-dimensional array of detonating cords.

The disclosed components and their arrangements as disclosed herein all contribute to the novel features of this invention. The novel features of detonating cord 10 and its manufacturing process assure more reliable detonation of explosive charges that are assembled into line charges or other ordnance systems having detonating cords.

The constituents of detonating cord 10 might be modified or otherwise tailored so that detonating cord 10 may satisfactorily perform for different tasks, yet such modifications will be within the scope of this inventive concept. For example, in accordance with this invention, many other suitable fibers or yarns other than polyamide could be used for braided layers 12 and 15; flexible materials other than silicone rubber could be used for flexible layer 13; and different glues might be selected for glue 14; and the relative dimensions of any or all of the constituents could be different to accommodate other ordnance requirements. Different explosive materials for core 11 could be used when the tasks are different, or different brisance is called for or safety standards are different. These components can be incorporated into detonating cord 10 and its fabrication procedure to accommodate different requirements without departing from this invention.

Furthermore, having this disclosure in mind, one skilled in the art to which this invention pertains will assemble suitable components in different configurations. For example, detonating cord 10 may need to be modified with interfacing structure that assures that the transfer of detonation to different types of ordnance and arrangements of ordnance. Therefore, the disclosed detonating cord 10 and its method of manufacturing are not to be construed as limiting, but rather, are intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A detonating cord comprising:

a core of plastic-bonded, granular explosive containing RDX, stearic acid, and hydroxyethyl cellulose;

means for containing said explosive core;

means disposed on said containing means for sealing said explosive core; and means disposed on said sealing means for further containing said explosive core.

2. A detonating cord according to claim 1 further comprising: means coated on said sealing means for adhering said further containing means thereto.

3. A detonating cord according to claim 2 further comprising:

means coupled to at least one end of said further containing means for disposing booster explosive axially adjacent said explosive core.

4. A detonating cord according to claim 3 in which said explosive core is comprised of a continuously extending, wire-shaped volume of explosive.

5. A detonating cord according to claim 4 in which said containing means and said further containing means are comprised of an inner braided layer and outer braided layer of polyamide yarns, respectively.

6. A detonating cord according to claim 5 in which said inner braided layer is comprised of a pair of different types of polyamide yarns, said outer braided layer is comprised of one type of polyamide yarn, and said booster explosive disposing means is a cup-shaped container crimped and adhered onto said outer braided layer.

7. A method of manufacturing detonating cord comprising the steps of:

providing a core of PBXN-8 slurry;

weaving an inner braided layer of polyamide yarn on said core of PBXN-8 slurry;

applying a flexible sleeve of silicone rubber on said inner braided layer;

coating glue on said flexible sleeve; and weaving an outer braided layer of polyamide yarn on said glue.

8. A detonating cord according to claim 7 further comprising:

glue coated on said sealing sleeve to adhere said outer braided layer thereto.

9. A detonating cord according to claim 8 further comprising:

booster cup crimped onto said outer braided to place a booster charge adjacent said explosive core.

* * * * *